US006672114B2

(12) United States Patent
Glover et al.

(10) Patent No.: US 6,672,114 B2
(45) Date of Patent: Jan. 6, 2004

(54) APPARATUS FOR BATCH DYEING

(75) Inventors: Benjamin H. Glover, Easley, SC (US); Robert David Nabow, Spartanburg, SC (US); Bruce R. Edwards, Tryon, NC (US); Stephen Kelly Stewart, Campobello, SC (US)

(73) Assignee: Milliken & Company, Spartanburg, SC (US)

( * ) Notice: Subject to any disclaimer, the term of this patent is extended or adjusted under 35 U.S.C. 154(b) by 24 days.

(21) Appl. No.: 10/045,847

(22) Filed: Jan. 10, 2002

(65) Prior Publication Data

US 2003/0126895 A1 Jul. 10, 2003

(51) Int. Cl.[7] ..... D06B 5/02

(52) U.S. Cl. ..... 68/178; 68/178; 68/179; 68/184; 68/181 R

(58) Field of Search ..... 68/184, 181 R, 68/177, 178, 179, 207, 17 R

(56) References Cited

U.S. PATENT DOCUMENTS 3,510,251 A * 5/1970 Fujii et al.
3,587,256 A * 6/1971 Spara
3,685,325 A * 8/1972 Carpenter
3,780,544 A * 12/1973 Turner et al.
3,921,420 A * 11/1975 Aurich et al.
3,949,575 A * 4/1976 Turner et al.
4,483,032 A * 11/1984 Christ et al.
4,656,846 A * 4/1987 Damm
4,716,744 A * 1/1988 Turner et al.
4,829,620 A * 5/1989 Christ et al.
4,873,847 A * 10/1989 Kasai et al.
4,881,384 A * 11/1989 Chicharro
5,170,523 A * 12/1992 Scholl
5,520,027 A * 5/1996 McCartney et al.
5,850,651 A * 12/1998 Ishimaru et al.

OTHER PUBLICATIONS

Tri–Clover, Inc.; Tri–Blender sets the pace with fast and uniform In–Line or Batch Blending; 1989.
Penberthy. Inc.; Section 1000, Bulletin 1200, Penberthy—Jet Pump Technical Data—Pumping Liquids; 5/87.

* cited by examiner

*Primary Examiner*—Frankie L. Stinson
(74) *Attorney, Agent, or Firm*—Terry T. Moyer; Jeffery E. Bacon

(57) ABSTRACT

The jet dye apparatus includes a reactant chamber for the processing or various materials and liquids, and a pump for recirculating the liquids to and from the reactant chamber. A jet venturi or nozzle receives the material from the reactant chamber and returns the material to the reactant chamber through a return tube. A portion of the liquids from the pump are supplied to the jet venturi. An inductor receives a portion of the liquids from the pump before they are returned to the reactant chamber. The inductor combines the liquids with granular or powder additives from an additive container.

20 Claims, 3 Drawing Sheets

*FIG. —1—*

PRIOR ART

APPARATUS FOR BATCH DYEING

BACKGROUND

The present invention generally relates to apparatuses for the process of dyeing and treating material, and in particular, to apparatuses for the batch process of dyeing material.

In a batch dyeing process, a material is subjected to various conditions in order to accomplish the dyeing of the material. In one of these conditions, the material is scoured after the dyeing substances are applied in an effort to remove any residual dyeing substances on the material. The chemicals that are used for scouring can be very volatile and reactive chemicals. In particular, reductive powders or the granular form of the scouring chemicals are highly volatile.

The scouring chemicals must only be added to the batch process at a specific critical time in the dyeing process. Additionally, the scouring chemicals must be blended into the liquids of the batch dyeing process in a manner that reduces the possibility of the reactive scouring chemicals contacting the material in a concentrated form or consistent method. For these reasons, scouring chemicals are typically added to the batch dyeing process in a liquid form.

However, additive liquid scouring materials often exhibit different characteristics than the granular or powder scouring chemicals. Additionally, many of the powder or granular scouring chemicals begin to degredate immediately upon combination with an additive liquid before addition to the liquids in a batch dye process.

Therefore, there is a need for apparatuses that can add powder or granular additives, such as scouring chemicals, to a batch process for treating a material, such as a batch dyeing process, in a controlled manner.

BRIEF DESCRIPTION OF THE DRAWINGS

The present invention can be better understood with reference to the following figures.

DETAILED DESCRIPTION

Figure 1:
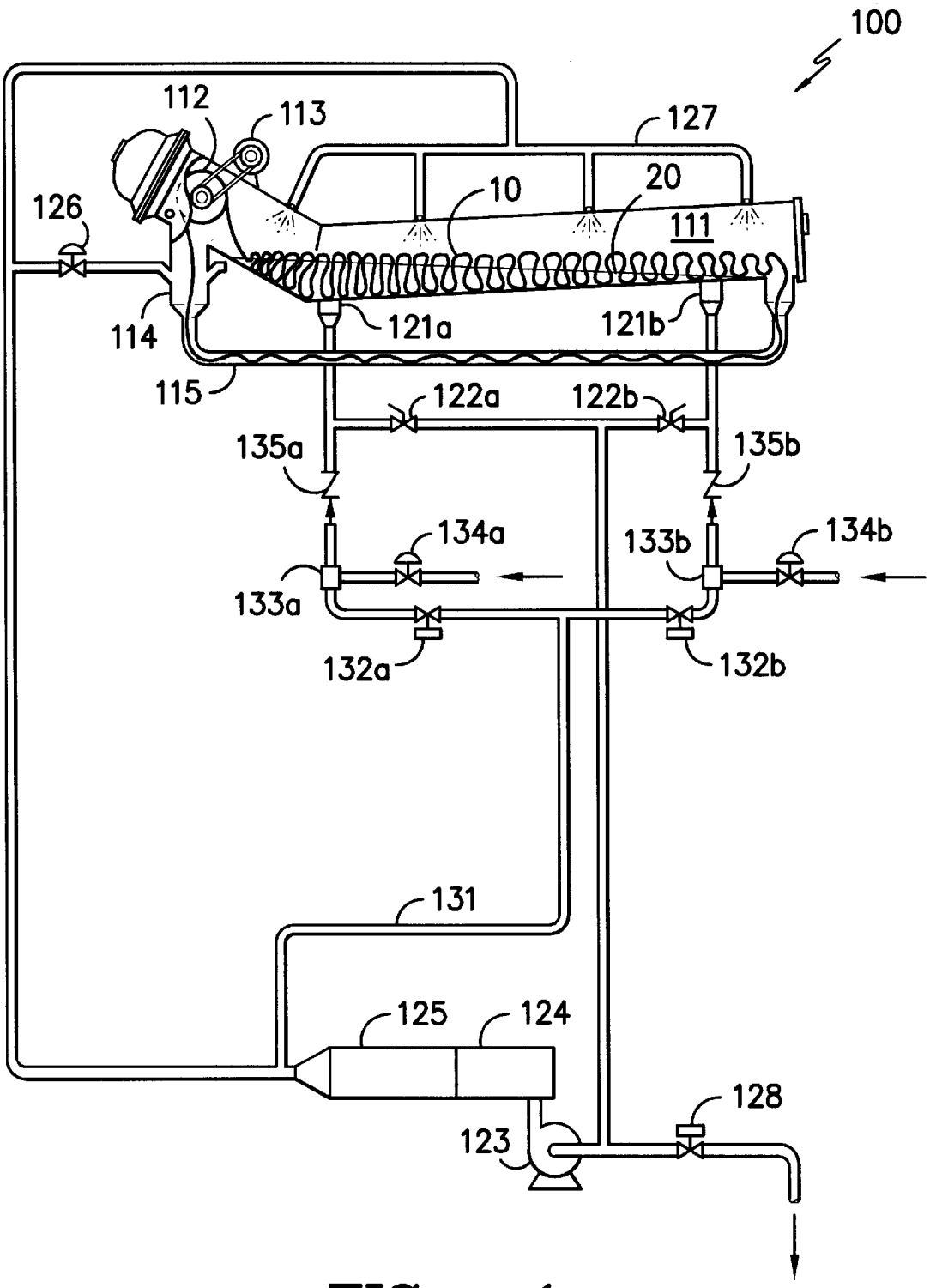
FIG. 1 is a diagram illustrating a jet dyeing apparatus of the prior art.

The present invention generally relates to the addition of granular or powder additives into a batch dye process, such as a dye process using a prior art jet dye apparatus 100 as illustrated in FIG. 1. The jet dye apparatus 100 generally includes a reactant or kier chamber 111 for the processing of various materials, such an loop of textile 10, with various liquid dyes and chemicals 20. As illustrated, the textile 10 progresses from the reactant chamber 111 over a lifter reel 112 which is rotated by a motor 113. After passing over the lifter reel 112, the textile 10 passes through a jet nozzle or venturi 114 which exhausts into a return tube 115. The return tube 115 empties the materials into the opposite end of the reactant chamber 111 from the jet venturi 114.

The liquids 20 are removed from the bottom of the reactant chamber 112 through drain or suction ports 121*a* and 121*b* in the bottom of the reactant chamber 111. The liquids 20 from the suction ports 121*a*, 121*b*, pass through recirculated flow control values 122*a* and 122*b* to the pump

123. The pump 123 forces the liquids 20 through a filter 124 and a heat exchanger 125. The liquids 20 leave the heat exchanger 125 and are forced through a venturi pressure control valve 126 into the jet venturi 114, and to a spray assembly 127 located in the top of the reactant chamber 111. To remove liquids 20 from the batch system in the jet dye apparatus 100, a system drain valve 128 is positioned before the pump 123, which allows the draining of the liquids 20 from the system.

At various times during the batch process, it will be necessary to add dye solutions and/or chemical solutions to the liquids 20 in the batch process. The liquids 20 under pressure from the pump 123 are received in a supply recirculation passage 131 after passing through the heat exchanger 125. The liquids 20 from the supply recirculation passage 131 pass through recirculation flow control valves 132*a* and 132*b* before reaching supply recirculation eductors 133*a* and 133*b*, respectively. The liquid dye supply or liquid chemical supply are provided to suction side of the supply recirculation eductors 133*a* or 133*b*, respectively, after passing through supply control valves 134*a* or 134*b*, respectively. The combination of recirculation liquids and the additive fluids from the supply recirculation eductors 133*a*, 133*b*, are returned to the stream of liquid coming from the suction ports 121*a*, 121*b*, prior to the recycled control valves 122*a* or 122*b*. Supply recirculation check valves 135*a* and 135*b* prevent fluids from back flowing into the supply recirculation eductors 133*a* and 133*b*, respectively, from the drain ports 121*a* or 121*b*.

Figure 2:
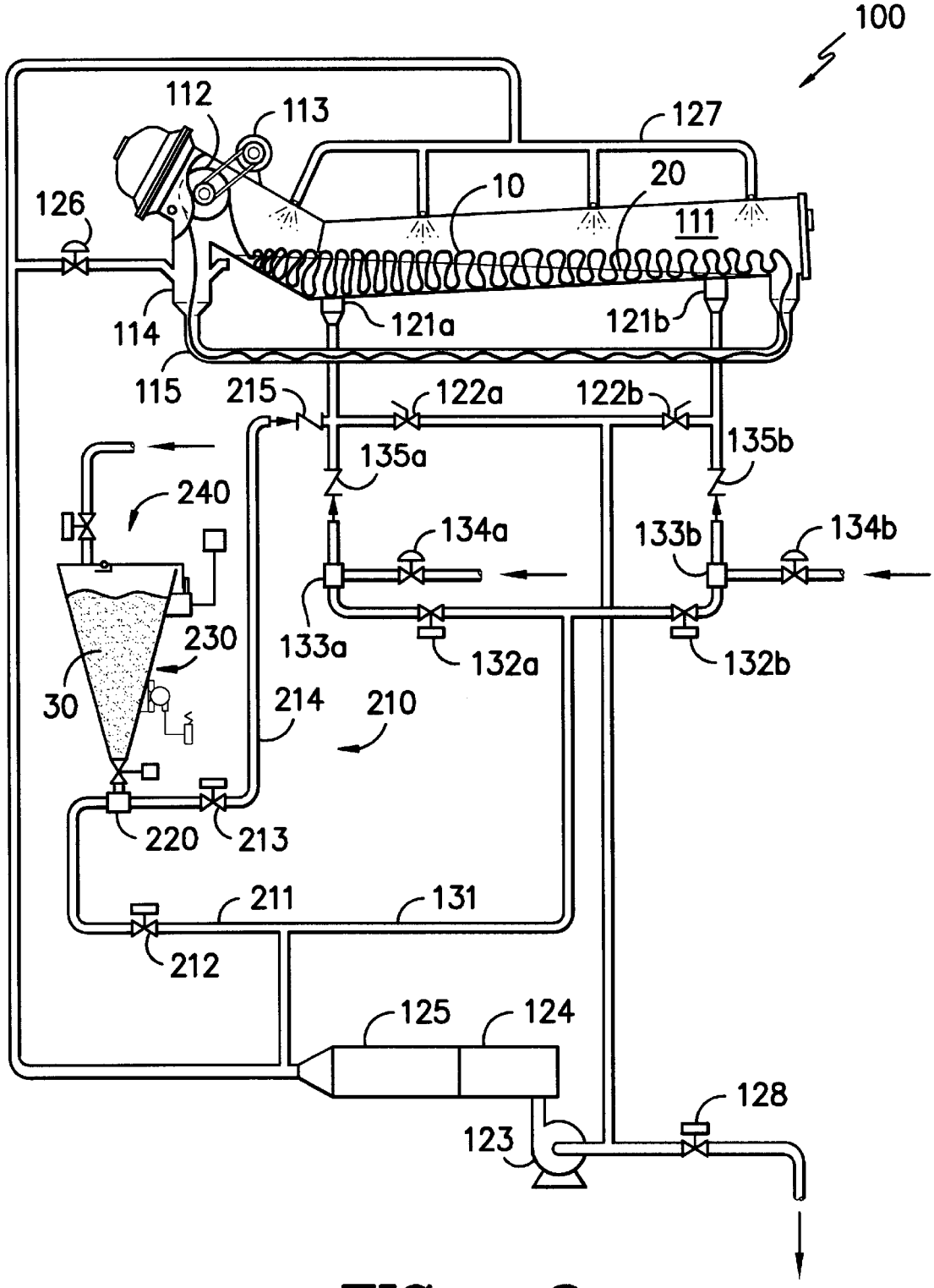
FIG. 2 is a diagram illustrating a jet dyeing apparatus with the improvements of the present invention thereon.

Referring now to FIG. 2, there shown the improvement of the present invention as illustrated on the batch jet dye apparatus 100. The batch jet dye apparatus operates as described above with respect to FIG. 1, with the improvements of the present invention. The improvements of the present invention generally comprise the addition of an additive recirculation circuit 210, an additive eductor 220, an additive supply apparatus 230, and an extinguishing system 240. As used herein, the term eductor shall mean a device that uses the flow of a fluid to mix another substance with that fluid.

The additive recirculation circuit 210 includes an additive recirculation receipt passage 211, additive recirculation flow control valves 212 and 213, an additive recirculation supply passage 214, and an additive recirculation check valve 215. The additive recirculation receipt passage 211 receives liquid 20 under pressure by the pump 123 after the heat exchanger 125, and provides that liquid 20 via the first additive recirculation control valve 212 to the additive eductor 220. The additive eductor 220 adds and mixes a granular or powder additive 30 from the additive supply apparatus 230 into the liquid 20 throttling through the additive eductor 220. The liquid 20 leaving the additive eductor 220 passes through the second additive recirculation control valve 213 and is provided by the additive recirculation supply passage 214 to the stream of liquid from the suction port 121*a* to the recycled control valve 122*a*, via the additive recirculation check valve 215. In this manner, the additive recirculation check valve 215 prevents fluid from the drain port 121*a* from entering the additive recirculation supply passage 214. In another embodiment, the additive recirculation supply passage 214 returns the liquid 20 from the additive eductor 220 to the reactant chamber 111, via the additive recirculation check valve 215, below a false bottom in the reactant chamber 111 that holds the material 10 from the discharge of the liquid 20 from the additive recirculation supply passage 214 and the suction ports 121*a* and 121*b*.

Figure 3:
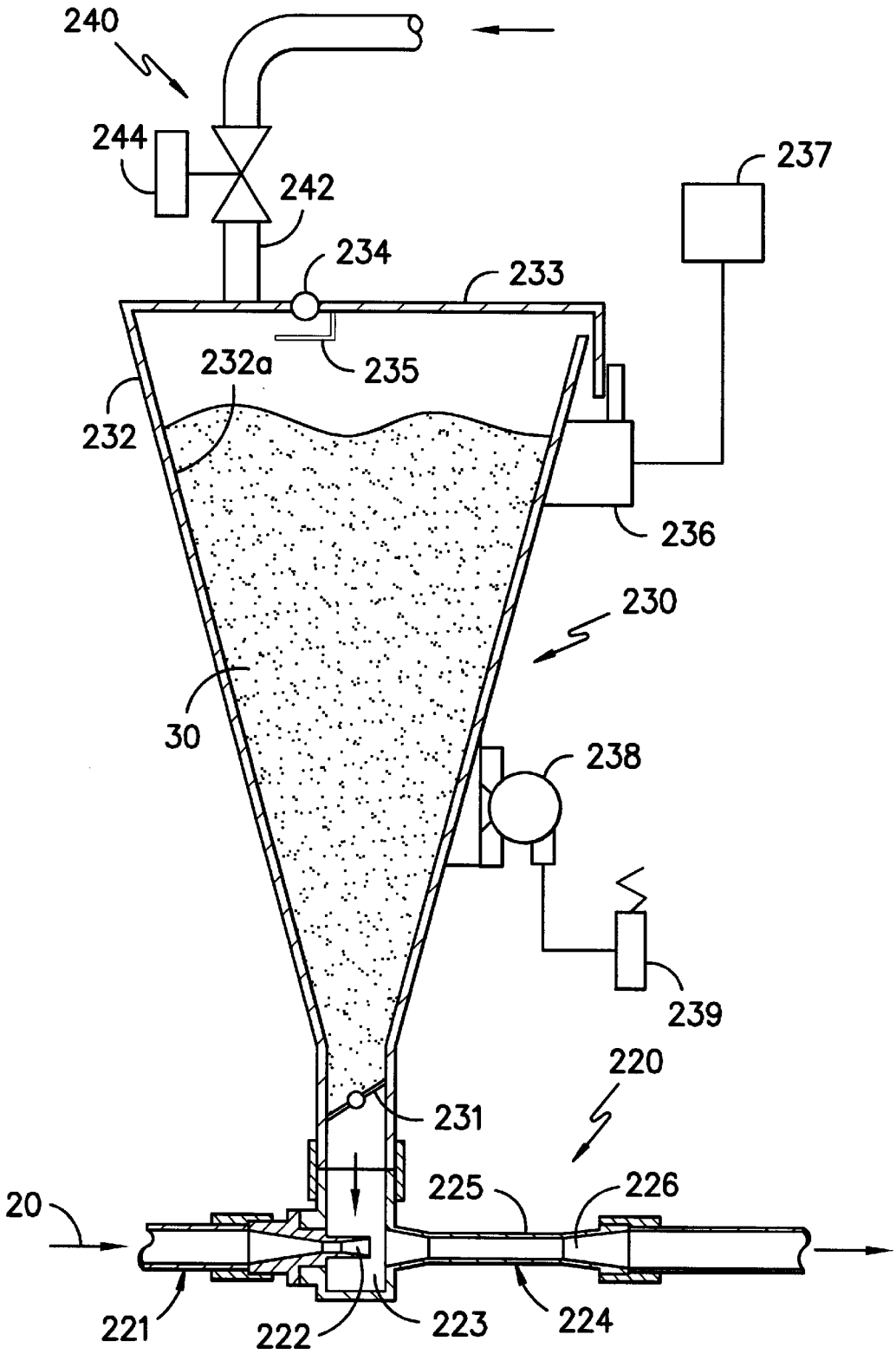
FIG. 3 is a cross sectional view of the eductor and holding device from the improvement of the present invention illustrated in FIG. 2.

Referring now to FIG. 3, there is shown a cross sectional view of the additive eductor 220, the additive supply apparatus 230, and the extinguishing system 240. The additive eductor 220, as illustrated in FIG. 3, is a jet pump. An example of a jet pump that can be used in the present invention is the model LM Jet Pump by Penberthy, Inc., in Prophetston, Ill. As illustrated in FIG. 3, the eductor 220 generally includes an inlet section 221, a suction section 223, and a discharge section 224. The inlet section 221 receives the liquid 20 from the additive recirculation receipt passage 211, and passes that liquid through an inlet nozzle 221 which directs the liquid 20 through the suction chamber 223 into the discharge section 224. The smaller diameter of the inlet nozzle 222 accelerates the liquid 20 as it passes through the suction chamber 223, thereby inducing substances in the suction chamber 223 to entrain with the liquid 20 passing into the discharge section 224. The discharge section 224 includes a parallel section 225, and a diffuser section 226. The substance from the suction chamber 223 entrained in the liquid 20 mixes with the liquid 20 and acquires energy in the parallel section 225 of the discharge section 224. As the liquid 20 passes through the diffuser 226 of the discharged section, the mixture is converted to a pressure greater than the section pressure.

The additive supply apparatus 230 generally comprises a additive supply valve 231 that provides the dry additive 30 from an additive container or holding device 232 to the additive passage 226 in the additive eductor 220. As illustrated, the additive supply valve 231 is a butterfly type valve that can be controlled by the controls operating the system. Side walls 232*a* of the holding device 232 are preferably sloped to avoid bridging of the powder or granular additive 30, which would inhibit the flow of the additive 30 from the holding device 232 to the additive eductor 220. The side walls 232*a* slope to the additive supply valve 231, thus preventing horizontal surfaces in the additive holding device 232 which can hold some of the additive 30 from passing into the additive eductor 220. In one embodiment, the side walls 232*a* of the holding device 232 are angled not more than about 45 degrees from the vertical. In another embodiment, the side walls 232*a* of the holding device 232 are angled not less than about 25 degrees from the vertical.

A lid 233 is secured to the holding device 232 by an hinge 234 for protecting the additive 30 inside the holding device 232. The lid 233 also includes a hinge shield 235 for protecting the hinge 234 from the additive 30, and the additive 30 from any material that my incidentally pass through or from the hinge 234. A lid locking mechanisum, such as the lid lock solenoid 236, inhibits the opening of the lid 234 until a lid lock control 237 releases the lid lock solenoid 236. The lid lock control 237 can be an activation providing the current necessary to activate the solenoid 236 upon pushing a button or throwing a switch, or a part of the process control for the batch system that only activates the solenoid 236 during critical times of the process, including before and/or after the process. In the event that the additive is also corrosive or reacting some, or all, of the holding device side walls 232*a*, lid 233, hinge 234, hinge shield 235, additive supply valve 231, and/or eductor 220 can be formed of 316 stainless steel.

A holding device vibrator 238 attached to the hopper 232 facilities the progression of the dry additive 20 through the hopper 232. A regulator 239 controls the operation of the hopper vibrator 238. Use of the holding device vibrator 238 helps prevent bridging of the additive 30 in the holding device 232, and helps reduce the possibility of small amounts of the additive 30 to cling to the side walls 232*a* of the additive holding device 232 and not pass into the additive eductor 220. Additionally, providing the insides or face of the side walls 232*a* with a mirror type surface will facilitate the progression of the additive 30 to the eductor 220.

The extinguishing system 240 can be a supply inlet 242 into the holding device 232 that is controlled by a mechanism such as a valve 244. The extinguishing medium that is supplied by the extinguishing system 240 must be selected appropriately to accommodate the additive in the holding device 232. When the appropriate extinguishing medium is water, the extinguishing system 240 can also be used to clean the holding device 232. The extinguishing system 240 can also be used to place a gas pad or protective gas layer on the additive 30 in the additive holding device 232.

In a batch dyeing process, the granular or powder scouring chemicals are placed in the additive holding device 232 just prior to the need for the chemicals. The locking mechanism 236 can be used to prevent adding the chemicals to the holding device 232 until close to the critical time the chemicals are needed, in order to reduce any risks associated with having the chemicals out of a controlled environment. Once the additive chemicals 30 are placed in the holding device 232, a gas layer can be placed on the additive 30, such as nitrogen, to give added protection to the chemicals 30 in the holding device 232. Once the batch process is at the point where the granular or powder additives are needed, the flow control valves 212 and 213 are opened to create a flow of liquid 20 through the additive eductor 220, and then the additive supply valve 231 opens to allow the additive 30 to be drawn into and mix with the liquid 20 within the additive eductor 220. After the appropriate amount of additive 30 has be mixed into the liquid 20, the additive supply valve 231 is closed and then the flow control valves 212 and 213 are closed. The control of components of the additive recirculation circuit 210, the additive eductor 220, the additive supply apparatus 230, and the extinguishing system 240, can be controlled by a processor, such as the processors used on many of the prior art jet dye apparatuses to control the various components of that system.

Although the present invention has be described herein by reference to specific examples, the present invention is not mean to be limited by the specific details of those descriptions. For example, the additive eductor can be connected such that liquid flowing through the eductor is taken from the flow of liquid that has left the pump and returned as all, or some, of the liquid that is returned into the reactant chamber via the jet, sprays, or another inlet. As another example, the additive eductor can be connected such that the liquid flowing through the additive eductor is taken from the fluid leaving the reactant chamber, such as from the drain ports or another outlet, and returned as all, or some of the liquid flowing to the pump. In each of these examples, the additive eductor, the check valves, and the control valves will require orientation to accommodate the flow direction of the batch process. Additionally, flow restrictions may be necessary in any liquid flow parallel to the liquid flowing through the additive eductor, in order to maintain the liquid flow through the additive eductor.

What is claimed is:

1. An apparatus for mixing an additive with a liquid, and batch processing of a material with the liquid containing the additive, the apparatus comprising:

a reactant chamber, the reactant chamber providing a space for the processing of the material with the liquid containing the additive;

a pump connected to receive the liquid from the reactant chamber and to return the liquid to the reactant chamber;

a jet connected to receive the material from the reactant chamber, the jet further being connected to receive at least a portion of the liquid from the pump, before the liquid reaches the reactant chamber;

a return tube for returning the material and the liquid from the jet to the reactant chamber;

an additive container for holding the additive in a powder or granular form, the additive container having an additive output opening for the exit of the additive in the powder or granular form from the additive container, the additive container further having side walls angled relative to the vertical of the additive container such that the additive in the powder or granular form is directed towards the additive container output; and, an eductor connected between the pump and the reactant chamber such that at least a portion of the liquid passing through the pump and returning to the reactant chamber also flows through the eductor, the eductor further being connected to the additive container output such that the additive from the additive container is mixed with the liquid flowing through the eductor.

2. The apparatus according to claim 1, wherein the eductor is connected such that the flow of the liquid through the eductor is taken from the liquid flowing from the pump and returned to the liquid flowing to the pump.

3. The apparatus according to claim 2, further including a gas supply system connected to the additive container for dispensing a protective gas layer over the additive.

4. The apparatus according to claim 1, wherein the eductor is connected such that the flow of the liquid through the eductor is take from the liquid flowing from the pump and returned to the reactant chamber.

5. The apparatus according to claim 1 further including the lifter wheel inside the reactant chamber, the lifter wheel being positioned for the material to pass over the lifter wheel just prior to entering the jet.

6. The apparatus according to claim 5, further including the lifter wheel being motorized.

7. The apparatus according to claim 1, further including a heat exchanger connected to exchange heat with at least a portion of the liquid flowing through the pump.

8. The apparatus according to claim 1, further including spray nozzles located in an upper portion of the reaction chamber, and wherein a portion of the liquid from the pump returning to the reactant chamber passes through the spray nozzles.

9. The apparatus according to claim 1, wherein the side walls of the additive container are angled no more than about 45 degrees from the vertical.

10. The apparatus according to claim 1, wherein the side walls of the additive container are angled no less than about 25 degrees from the vertical.

11. The apparatus according to claim 1, wherein the additive container includes a valve positioned to control the flow of the additive from the additive container output to the eductor.

12. The apparatus according to claim 11, wherein the valve comprises a butterfly valve.

13. The apparatus according to claim 1, wherein the additive container includes a lid.

14. The apparatus according to claim 13, wherein the additive container further includes a lid locking mechanisum.

15. The apparatus according to claim 14, wherein the lid locking mechanisum comprises a solenoid.

16. The apparatus according to claim 1, further including a vibrator mounted to the additive container such that the vibrator will apply vibration to the side walls of the additive container.

17. The apparatus according to claim 1, further including a check valve connected after the eductor such that liquid flow towards the eductor is inhibited.

18. The apparatus according to claim 1, further including a valve positioned before the eductor to control the flow of the liquid to the eductor.

19. The apparatus according to claim 1, further including a valve positioned after the eductor to control the flow of the liquid from the eductor.

20. The apparatus according to claim 1, further including an extinguishing system connected to the additive container for dispensing an extinguishing medium to the additive.

* * * * *